US006032301A

United States Patent [19]

Wang

[11] Patent Number: 6,032,301

[45] Date of Patent: Mar. 7, 2000

[54] PLUNGER

[75] Inventor: Long-Sheh Wang, Chiayi, Taiwan

[73] Assignee: Chntuo Industrial Co., Ltd., Chiayi, Taiwan

[21] Appl. No.: 09/243,427

[22] Filed: Feb. 3, 1999

[51] Int. Cl.[7] ..... E03D 9/00

[52] U.S. Cl. ..... 4/255.06; 4/255.03; 4/255.04; 15/406; 15/407

[58] Field of Search ..... 4/255.01–255.09; 137/240; 134/169 C; 15/406, 407

[56] References Cited

U.S. PATENT DOCUMENTS

| | | | |
|---|---|---|---|
| 2,059,785 | 11/1936 | Gaik | 4/255.03 |
| 2,386,870 | 10/1945 | Lawton | 4/255.03 |
| 3,426,774 | 2/1969 | Conn | 15/406 |

FOREIGN PATENT DOCUMENTS

| | | | |
|---|---|---|---|
| 2268994 | 1/1994 | United Kingdom | 4/255.02 |

*Primary Examiner*—Henry J. Recla
*Assistant Examiner*—Tuan Nguyen
*Attorney, Agent, or Firm*—Rosenberg, Klein & Lee

[57] ABSTRACT

A plunger includes an upper base, a pressure ball under the upper base, a correlative tubular shaft extending vertically through the pressure ball, a handle pivotally connected with an upper end of the correlative tubular shaft, a connecting rod connects to the correlative shaft, and a lower end stopper threadably connected with the lower end of the connecting rod. The pressure ball can store air supplied by an air pump or compressor through an air inlet. The handle can be operated to let the air stored in the pressure ball flow through the correlative shaft, the connecting rod and the lower end stopper into a clogged pipe or drain for clearing passage with a large force of pressured air.

2 Claims, 6 Drawing Sheets

PLUNGER

BACKGROUND OF THE INVENTION

This invention relates to a plunger, particularly to one provided with an air pressure ball for storing air to be forcefully flowed into a clogged pipe or drain for clearing the clog.

A known conventional plunger shown in FIG. 6, includes a sucking cup 10 made of rubber connected with a long handle 20. In using it, the sucking cup 10 is placed on a mouth of a clogged pipe or drain of a toilet bowl as shown in FIG. 7, and is compressed and released alternately again and again so as to let it produce sucking force to turn over a clog and clear the passageway of the pipe or drain. However, this conventional has its sucking force quite limited, necessary to operate it laboriously to clear a clog and sometime cannot clear it due to small sucking force of the sucking cup 10, having not much practicability.

SUMMARY

The main object of the invention is to offer a plunger having a pressure ball under an upper base, a correlative tubular shaft extending vertically through the pressure ball and having its upper end combined with a handle pivotally connected with the upper base and its lower end connected with a connecting rod, and a lower end stopper threadably connected to the lower end of the connecting rod. Then air may be stored in the pressure ball by means of an air pump or compressor, and the handle is operated to pull up the correlative tubular shaft to let its lower end separate from the connecting rod so that the air stored in the pressure ball may forcefully flow out of the lower end stopper into clogged pipe for clearing the clog with a powerful force.

BRIEF DESCRIPTION OF DRAWINGS

This invention will be better understood by reference to the accompanying drawings, wherein.

DETAILED DESCRIPTION OF THE PREFERRED EMBODIMENTS

Figure 1:
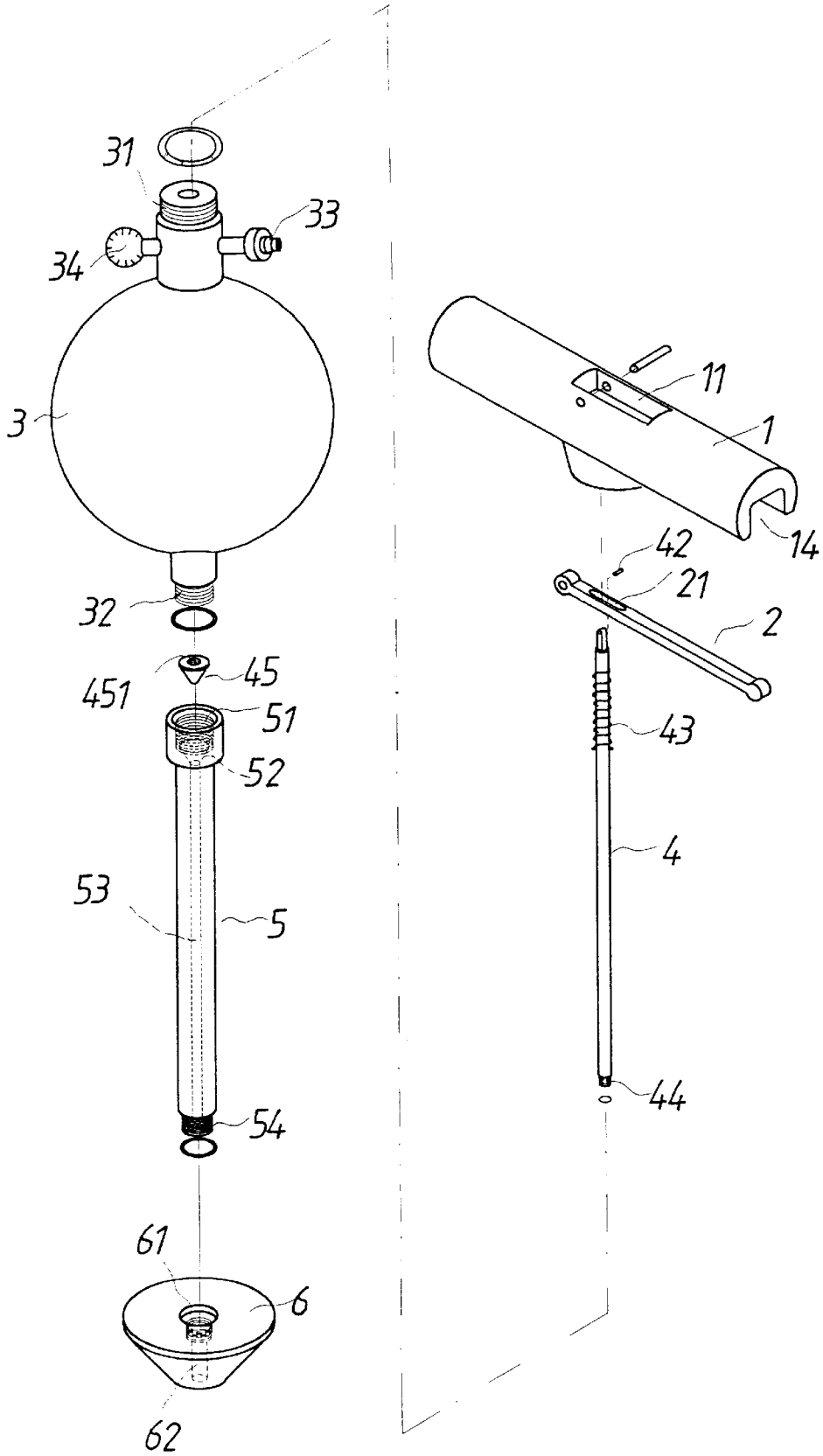
FIG. 1 is an exploded perspective view of a plunger of the present invention.
Figure 2:
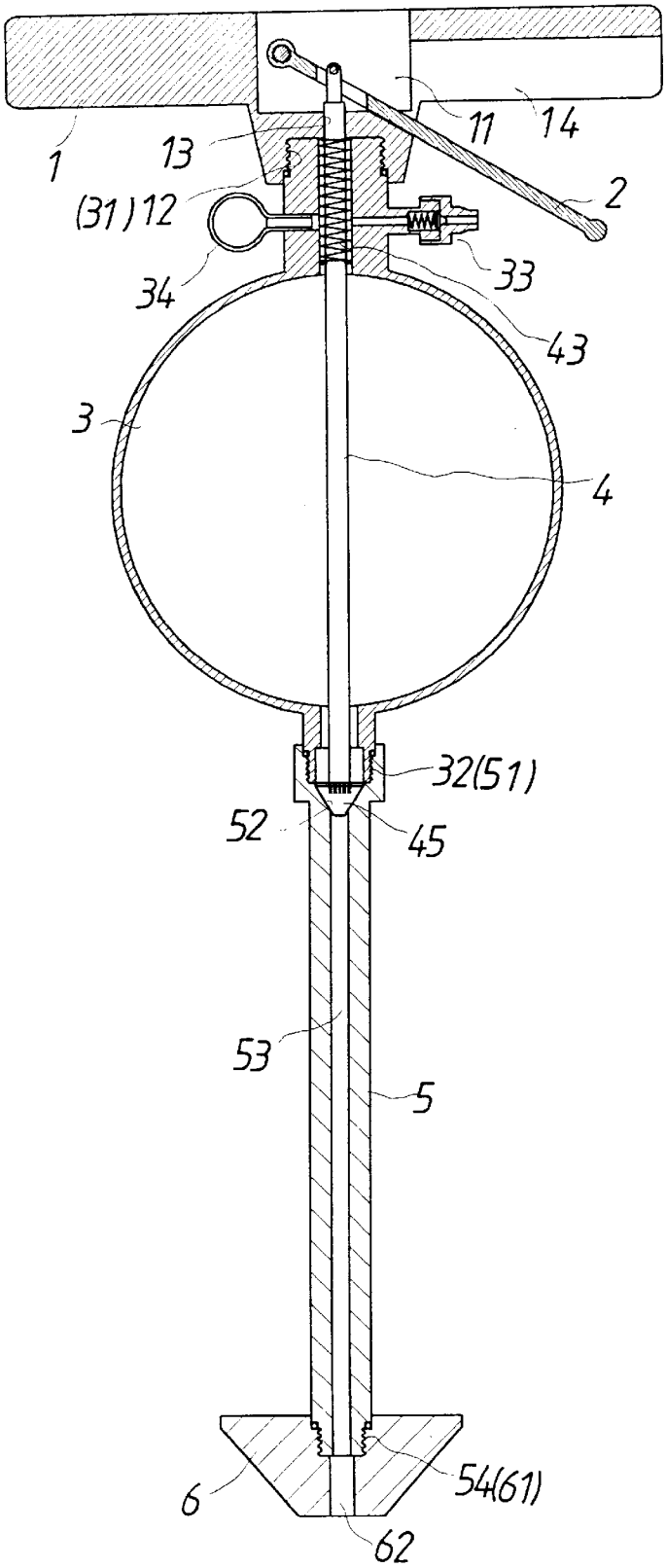
FIG. 2 is cross-sectional view of the plunger of the present invention.

A first preferred embodiment of a plunger of the invention, as shown in FIGS. 1 and 2, includes an upper base 1, a long handle 2, a pressure ball 3, a correlative tubular shaft 4, a connecting rod 5, and a lower end stopper 6 as main components combined together.

The upper base 1 has a hollow chamber 11 formed in an intermediate portion with an upper open side, a threaded hole 12 formed in a projecting lower portion, a hole communicating the chamber 11 with the threaded hole 12 in the projecting lower portion, and an opening 14 formed at a right lower side of the chamber 11.

The long handle 2 is pivotally connected in the hollow chamber 11 and located under the upper base 1, having a rear end protruding out of the opening 14 and a slot 21 formed in a front end.

The pressure ball 3 is to store air therein, having male threads 31 and 32 respectively in an upper and a lower end. The upper male threads 31 engage tightly with the threaded hole 12 of the upper base 1. The pressure ball 3 further has an air inlet 33 laterally provided at a right side of an upper block formed integrally with the pressure ball 3, and a pressure gauge 34 fixed at a left side of the upper block.

Figure 3:
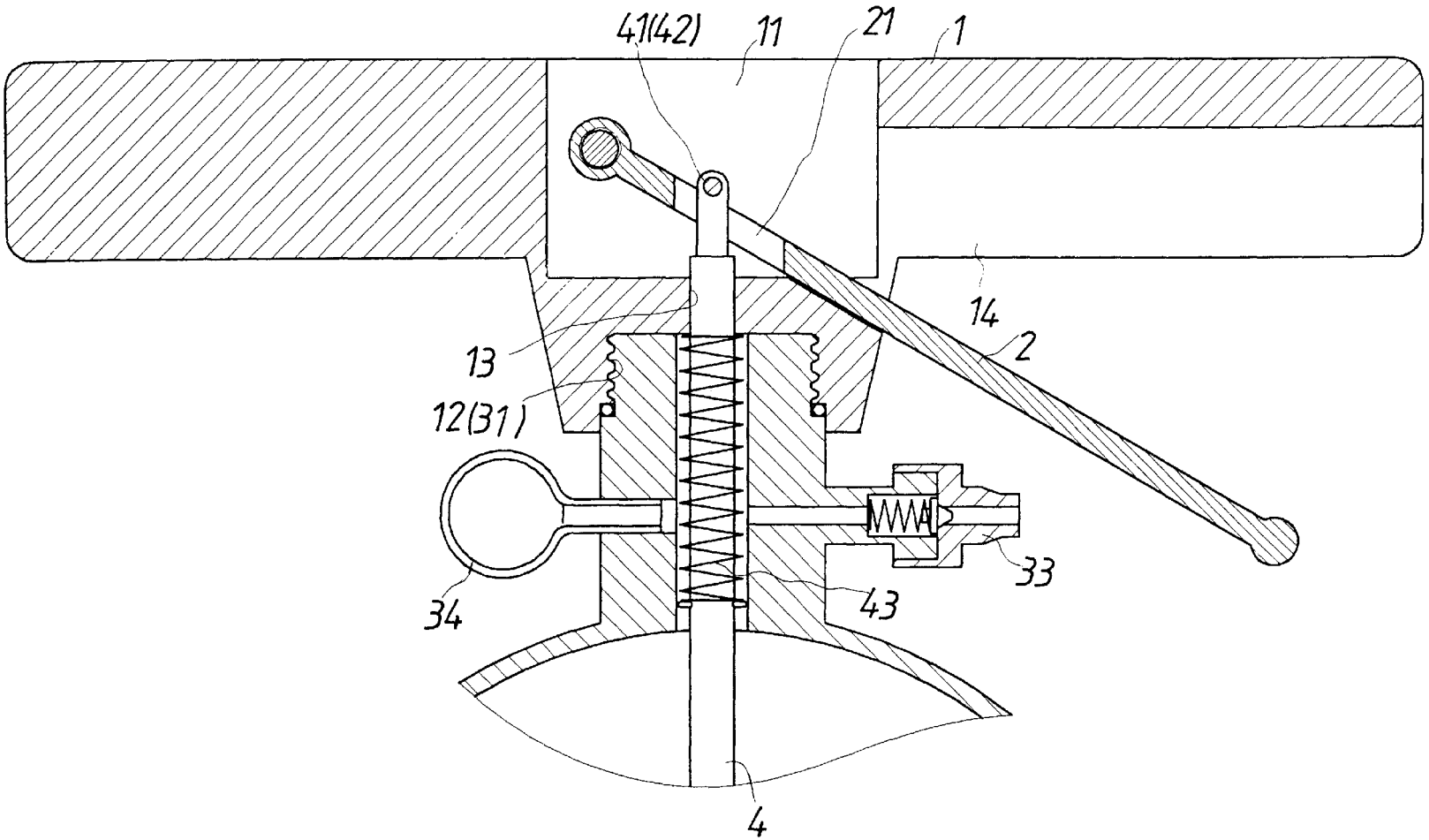
FIG. 3 is a partial enlarged cross-sectional view of the plunger of the present invention.

The correlative tubular shaft 4 has a hole 41 in an upper end for a pin 42 to pass laterally through and rest on two sides of the slot 21 of the handle 2 after the shaft 4 protrudes up through the slot 21, as shown in FIG. 3. Further, a coil spring 43 is fitted around an upper portion of the correlative shaft 4. The shaft 4 is further provided with male threads 44 formed in a lower end. A cone-shaped stopper 45 is provided to have female threads 451 for male threads 44 of the shaft 4 to engage tightly after the shaft 4 extends vertically down through the pressure ball 3.

The connecting rod 5 has female threads 51 formed in an upper end to engage the male threads 32 of the pressure ball 3. A short cone-shaped hole 52 formed under the female threads 51, a long passageway 53 formed under the cone-shaped hole 52, and male threads 54 in a lower end.

The lower end stopper 6 is cone-shaped, having female threads 61 in an upper end to engage the male threads 54 of the connecting rod 5. A center hole 62 under the female threads 61 communicating with the passageway 53 of the connecting rod 5 for air to flow through down.

In assembling, referring to FIGS. 2 and 3, firstly the handle 2 is pivotally combined with the upper base 1, and then the coil spring 43 is fitted around the correlative shaft 4, which is then inserted up through the slot 21 of the handle 2, with the pin 42 made to pass through the hole 41, combining the correlative shaft 4 with the handle 2. Next, the lower end of the correlative shaft 4 is inserted vertically down in the pressure ball 3, with the male threads 44 protruding out of the pressure ball 3 and engaging with the female threads 451 of the upper end stopper 45, and with the male threads 31 engaging with the threaded hole 12 of the upper base 1. After that, the male threads 32 of the pressure ball 3 is made to engage the female threads 51 of the connecting rod 5. Meanwhile, the cone-shaped upper stopper 45 just fits in the cone-shaped hole 52 of the connecting rod 5, and the male threads 54 engage tightly with the female threads 61 of the lower end stopper 6. Then the plunger is finished in assemblage.

Figure 4:
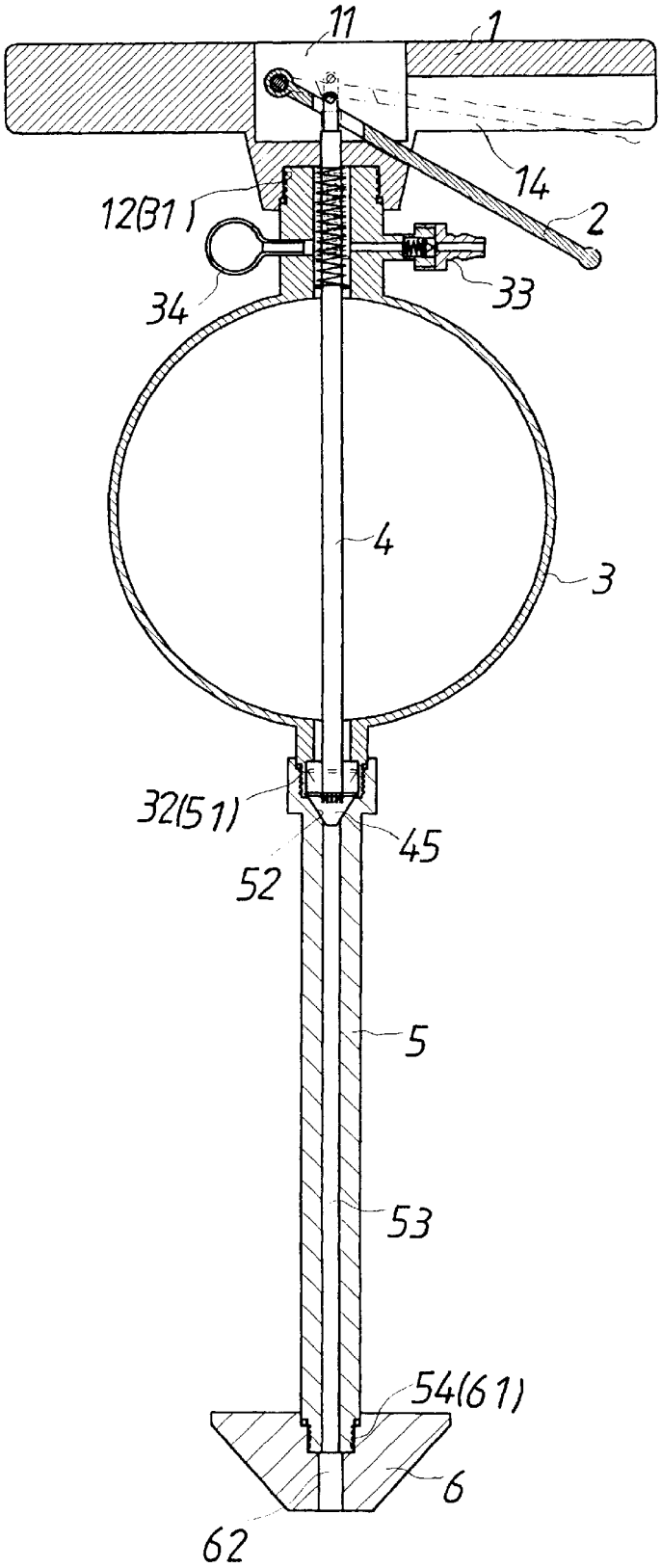
FIG. 4 is a cross-sectional view of the plunger of the present invention, showing it being operated.

In using, referring to FIG. 4, the lower end stopper 6 is placed sealingly on the mouth of the clogged pipe or drain, and the air inlet 33 is connected to a compressor or an air pump. Then air is pumped through the air inlet 33 into the pressure ball 3, which then stores air therein. Meanwhile, the correlative shaft 4 is biased by the coil spring 43, with the upper stopper 45 forcefully pushing the cone-shaped hole 52 and hampering the air in the pressure ball 3 from flowing down. When a user checks the pressure gauge 34 and knows the pressure valve reaches the necessary one, the user pulls up the handle 2, forcing the upper stopper 45 separate from the hole 52 to cause an aperture between the both, so that the air in the pressure ball 3 may flow through the passageway 53 of the connecting rod 5, the hole 62 of the lower end stopper 6, and then into the clogged pipe or drain. Thus, the clog may be forcefully moved to clear the passage of the pipe or drain.

Figure 5:
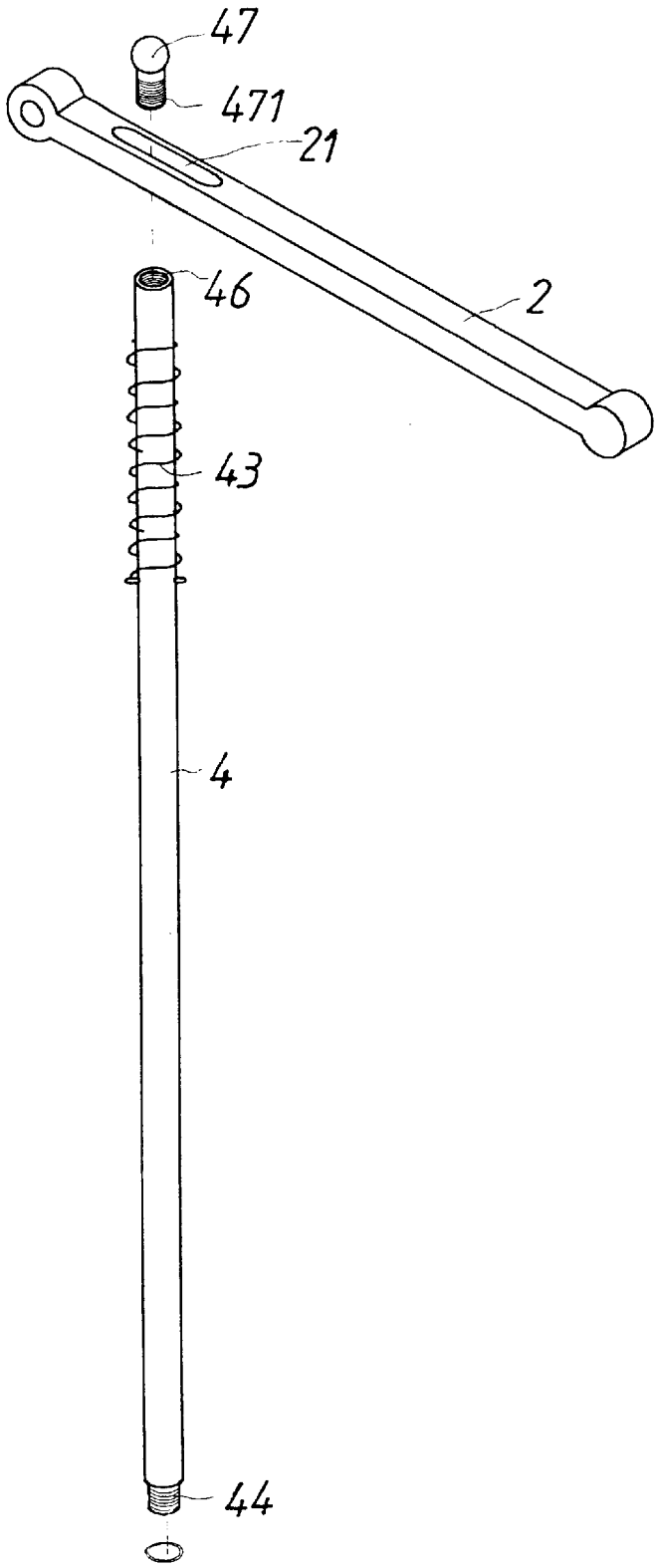
FIG. 5 is a partial perspective view of a second preferred embodiment of a plunger of the present invention.
Figure 7:
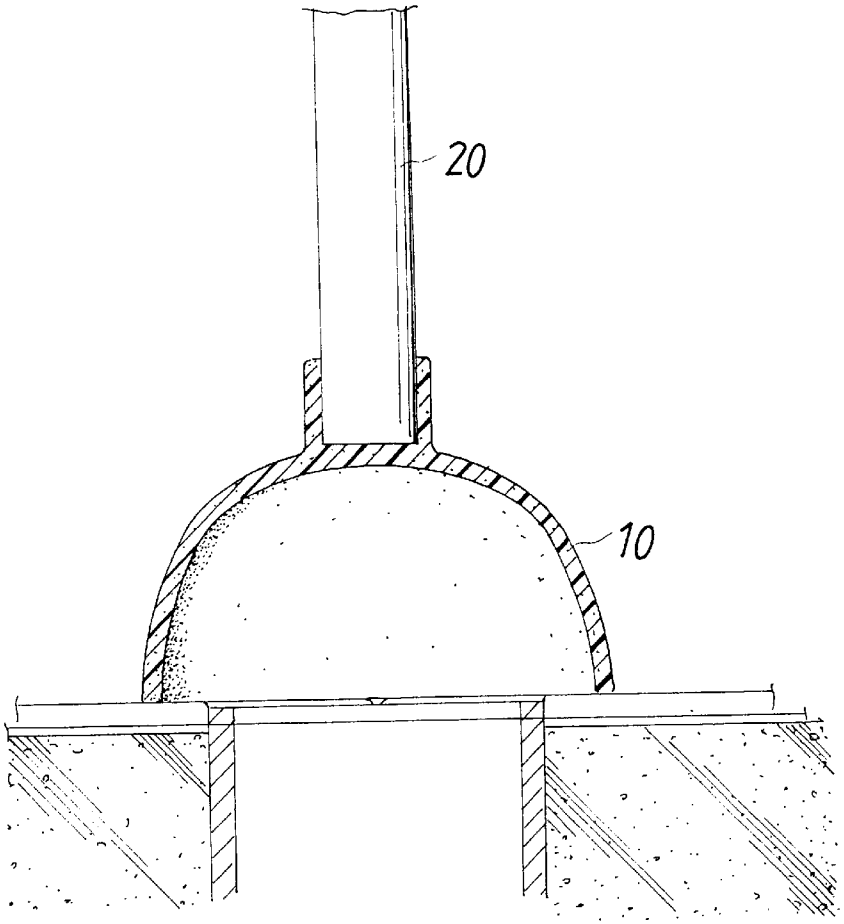
FIG. 7 (PRIOR ART)
FIG. 7 is a cross-sectional view of the known conventional plunger, showing it operating practically.
Figure 6:
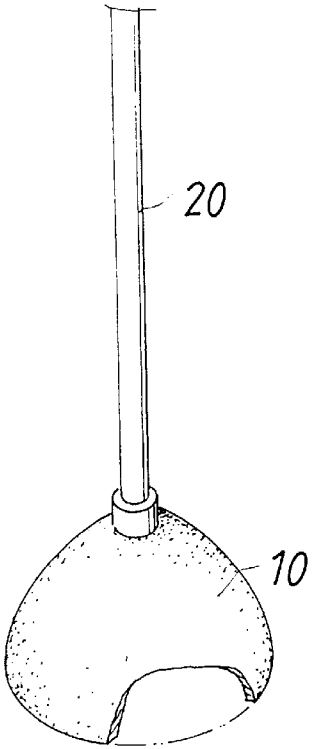
FIG. 6 (PRIOR ART)
FIG. 6 is a perspective view of a known conventional plunger.

A second preferred embodiment of the plunger in the present invention has the same structure as the first preferred embodiment, except the correlative shaft 4, which has a threaded hole 46 formed in the upper end, as shown in FIG. 5, for a screw 47 with a ball-shaped head and threads 471 to engage with. The diameter of the ball-shaped head has a larger diameter than the width of the slot 21 so that the screw 47 may rest on the slot 21 after the upper end of the correlative shaft protrudes up through the slot 21, securing the correlative shaft 4 with the handle 2.

In general, the plunger in the invention utilizes air pressure obtained by an air pump or compressor to be stored in the pressure ball for clearing a clogged pipe or drain.

What is claimed is:

1. A plunger comprising:

an upper base having a chamber with an upper open side formed in an intermediate portion, a threaded hole formed under said chamber, a hole communicating said chamber and said threaded hole, and an opening formed in a right lower portion to said chamber;

a handle having a slot in a front portion;

a pressure ball having male threads respectively in an upper projecting portion and a lower projecting end, an air inlet communicating with said ball, and a pressure gauge communicating with said ball;

a correlative tubular shaft having a hole in an upper end thereof, a coil spring fitted around an upper portion of said shaft, and male threads formed in a lower end thereof and an upper cone-shaped stopper having female threads engaging said male threads of said lower end;

a connecting rod having a longitudinal passageway therethrough, female threads in an upper end thereof, a cone-shaped hole formed adjacent said female threads, and male threads formed in the lower end of said passageway;

a lower end stopper having a cone shape with a longitudinal passageway extending therethrough, female threads in an upper end thereof engaging said male threads of said passageway of said connecting rod;

said handle pivotally connected in said chamber of said upper base, having its rear end extending out of said opening of said upper base, said correlative tubular shaft having it upper end protruding up through said slot of said handle, means in said upper end of said correlative tubular shaft for engaging said slot of said handle to move said correlative shaft with said handle, said correlative shaft having it lower end inserted vertically down through said pressure ball and its male threads engaging with said female threads of said upper stopper, said male threads of said pressure ball engaging with said female threads of said upper base, said upper stopper fitting in said cone-shaped hole of said connecting rod, said male threads of said connecting rod engaging tightly with said female threads of said lower end stopper, said pressure ball adapted to store air therein supplied by an air pump or compressor, whereby air stored in said pressure ball can flow out of said lower end stopper into a clogged pipe or drain for clearing its passage if said handle is swung up to pull up said correlative shaft to let said upper stopper separate from said cone-shaped hole of said connecting rod.

2. The plunger as claimed in claim 1, wherein said means in said upper end of said correlative tubular shaft comprises female threads in said hole of said upper end of said shaft for receiving a ball-head screw to engage with said slot of said handle, wherein said ball-head of said screw has a larger diameter than the width of said slot to rest on said slot to engage said correlative shaft with said handle, or a pin fitted laterally in said upper end of said correlative tubular shaft for engaging said slot of said handle to move said correlative shaft with said handle.

* * * * *